US007713097B2

(12) United States Patent
Eichhorst

(10) Patent No.: US 7,713,097 B2
(45) Date of Patent: May 11, 2010

(54) VARIABLE DIRECTION CABLE CONNECTOR ADAPTER

(75) Inventor: Stefan Eichhorst, West Bloomfield, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/185,848

(22) Filed: Aug. 5, 2008

(65) Prior Publication Data

US 2010/0035451 A1 Feb. 11, 2010

(51) Int. Cl.
*H01R 11/09* (2006.01)

(52) U.S. Cl. ..... 439/721; 439/213; 439/949

(58) Field of Classification Search ..... 439/721, 439/213, 76.2, 949
See application file for complete search history.

(56) References Cited

U.S. PATENT DOCUMENTS 3,670,295 A * 6/1972 Ege et al. ..... 439/709
4,944,691 A * 7/1990 Marach ..... 439/516
4,954,090 A * 9/1990 Shimochi ..... 439/76.2
5,011,421 A * 4/1991 Duke et al. ..... 439/213
5,057,026 A * 10/1991 Sawai et al. ..... 439/76.2
5,403,210 A * 4/1995 Hasegawa ..... 439/723

* cited by examiner

*Primary Examiner*—Hien Vu
(74) *Attorney, Agent, or Firm*—Quinn Law Group, PLLC

(57) ABSTRACT

An adjustable adapter for a cable connector with a fixed cable takeoff direction, relative to the cable connector, includes an input member having first and second terminals. A connecting member having first and second bus bars is configured to selectively mate to the input member in at least two different connecting member positions relative to the input member. In each of the different connecting member positions, each of the first and second bus bars is in electrical communication with a respective one of the first and second terminals. The connecting member accepts at least one cable connector, which therefore has at least two different, selectable cable takeoff directions relative to the input member. An adapter plate may facilitate mating of the cable connectors to the connecting member and the connecting member to the input member. A third terminal and third bus bar may allow for cable connectors with three cables.

19 Claims, 5 Drawing Sheets

VARIABLE DIRECTION CABLE CONNECTOR ADAPTER

TECHNICAL FIELD

This disclosure relates to connection and routing of cables to electrical components in automotive vehicles, such as power inverter modules.

BACKGROUND OF THE INVENTION

An electrical connection made by a connector has a fixed cable takeoff direction, which may be dependent on the design of the connector and the electrical unit to which it connects. Cables, especially large gauge, high-voltage cables (those having thicker diameter), are difficult to bend during installation. Large cables may have a minimum bend radius below which the cable cannot be bent and perform properly. Furthermore, the amount of sheathing or insulation may limit the ability of cables to achieve small-radius bends.

SUMMARY

An adjustable adapter for a cable connector is provided. The cable takeoff direction is fixed relative to the cable connector for first and second cables. The adjustable adapter includes an input member having first and second terminals. A connecting member having a first bus bar and a second bus bar is configured to selectively mate to the input member in at least two different connecting member positions relative to the input member. This provides connection such that in each of the different connecting member positions, each of the first and second bus bars is in electrical communication with a respective one of the first and second terminals.

The connecting member is configured to accept attachment of one or more cable connectors. The first bus bar is configured to communicate with the first cable on one cable connector and the second bus bar is configured to communicate with the second cable. Therefore, the connecting member provides the cable connector (or multiple cable connectors) with at least two different cable takeoff directions relative to the input member.

The connecting member may include an adapter plate configured to facilitate mating of the cable connectors to the connecting member and mating of the connecting member to the input member. The first and second bus bars may be embedded in the adapter place.

The input member may further include a third terminal, and a third bus bar may be embedded in the adapter plate or connecting member and in communication with the third terminal. The cable connectors may then carry three cables, and retain the ability to be connected in different positions relative to the input member.

The above features and advantages and other features and advantages of the present invention are readily apparent from the following detailed description of the best modes and other embodiments for carrying out the invention when taken in connection with the accompanying drawings.

DESCRIPTION OF PREFERRED EMBODIMENTS

Figure 1:
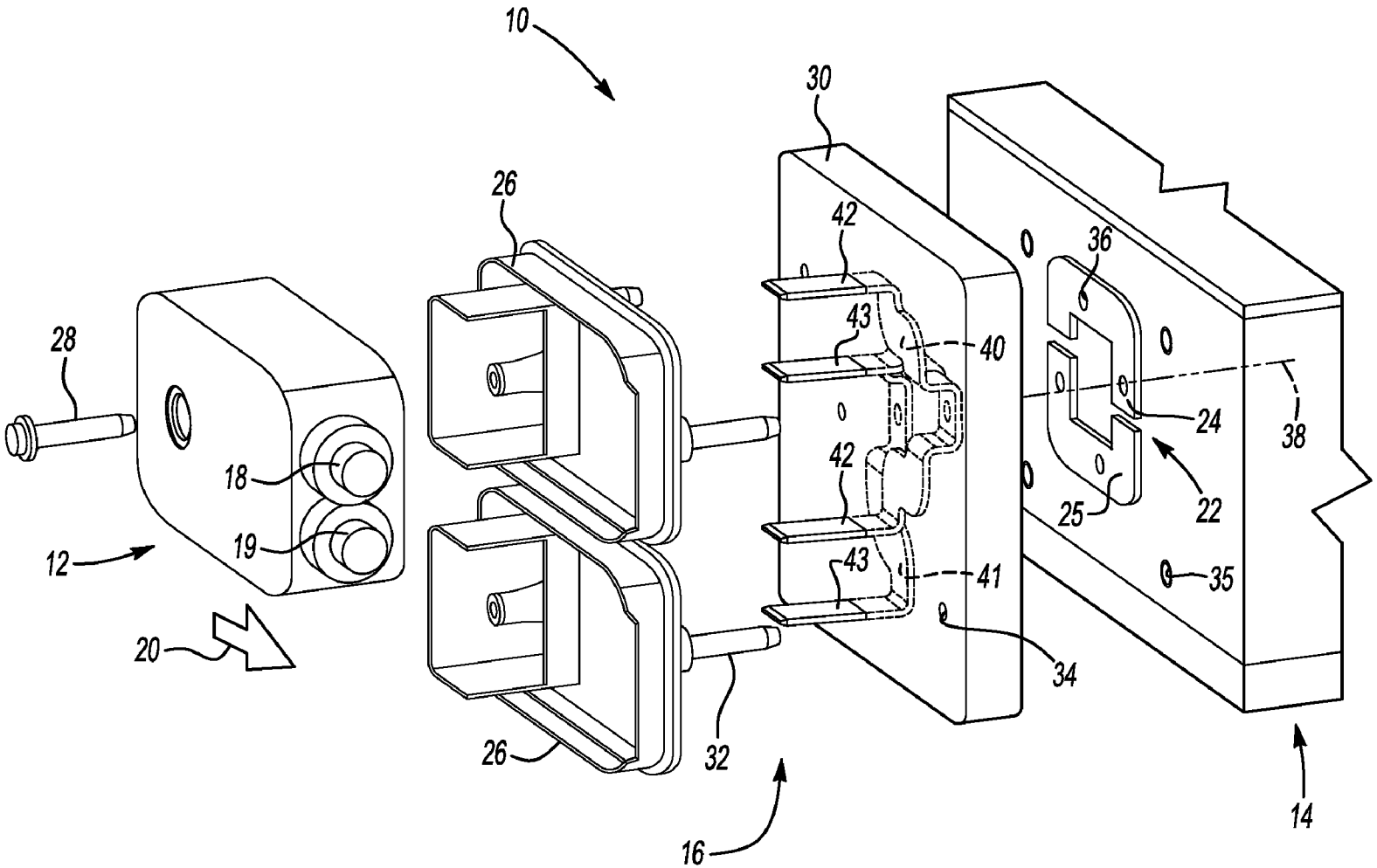
FIG. 1 is a schematic, exploded, perspective view of one embodiment of a variable direction cable connector adapter, configured for two-phase electrical communication with two, two-cable connectors.

Referring to the drawings, wherein like reference numbers correspond to like or similar components throughout the several figures, there is shown in FIG. 1 a partially exploded view of one embodiment of a variable direction cable connector adapter 10. One or more cable connectors 12 attach to an electrical module 14 via an adjustable header or connecting member 16. The electrical module 14 may be any of several devices known to those having ordinary skill in the art as having connections for cables—possibly large or high-voltage cables—such as, without limitation, a traction power inverter module (TPIM), transmission power inverter module, or another type of power inverter module.

The cable connector 12 shown in FIG. 1 has two cable ports 18 and 19, into which cables (not shown) may be inserted or attached. In this embodiment, the cable ports 18 and 19 define a fixed cable takeoff direction 20 relative to the cable connector 12 (and corresponding to direction 20A in FIG. 2A, described in more detail below).

Because large gauge cables, such as those used in high-voltage applications, are difficult to flex or bend, the cable takeoff direction 20—which may be defined by the cable ports 18 and 19—determines the path of the cables adjacent to the adapter 10. Different vehicle designs may require that the takeoff direction 20 be adjustable or selectable relative to the electrical module 14 in order for the different vehicles to use the same electrical module 14 and cable connector 12.

Bending or otherwise redirecting high gauge cables to account for an improper takeoff direction may add length (and mass) to the cables, take up extra space in the redirection area, and may increase the probability of damage or wear to the cables or sheathing. Because the cable takeoff direction 20 is fixed relative to the cable connector 12, selection and adjustability of the takeoff direction 20 relative to the electrical module 14 is provided by the adjustable connecting member 16.

An input member 22 contains the electrical interface for the electrical module 14. In the embodiment shown in FIG. 1, input member 22 includes two terminals 24 and 25. Each of the two terminals 24 and 25 will provide electrical communication between the electrical module 14 and one cable port 18 (corresponding to one cable) of the cable connector 12. The two phase cable connector 12 shown in FIG. 1 may be designed for DC circuits, in which one cable carries positive charge and the other cable negative.

The adjustable connecting member 16 is configured to allow the cable connector 12 to be selectively attached in different orientations relative to the input member 22 and electrical module 14, such that the cable takeoff direction 20 correspondingly varies with respect to the input member 22. Furthermore, the adjustable connecting member 16 provides structure configured to allow the fixed terminals 24 and 25 to communicate with the cable connector 12.

Adjustable connecting member 16 includes two cradles 26, each configured to accept one cable connector 12. The cable connector 12 may be mated to one of the cradles 26 by a snap or press fit between walls of the cradle 26 and the cable connector 12. Alternatively, as shown in FIG. 1, the cable connector 12 may be mated to the cradle 26 by a fastener or bolt 28, which threads into the cradle 26.

Those having ordinary skill in the art will recognize that, while only one cable connector 12 is shown, the adapter 10 contains structure configured to accept two cable connectors 12. Those having ordinary skill in the art will further recognize that, in the embodiment shown, the two cradles 26 provide for the two cable connectors 12 to be mounted to the adjustable connecting member 16 with substantially parallel cable takeoff directions 20. However, the cradles 26 could be configured to provide for different cable takeoff directions 20 for each connector 12.

The adjustable connecting member 16 further includes an adapter plate 30. The cradles 26 may be attached or fastened to the adapter plate 30, or may be formed integrally as features of the adapter plate 30. As will be recognized by those having ordinary skill in the art, the adapter plate could be configured to directly accept attachment of the cable connectors 12 without cradles 26.

The adapter plate 30 contains structure to mount the adjustable connecting member 16 to either the input member 22 or the electrical module 14, or both. In the embodiment shown in FIG. 1, four fasteners or bolts 32 pass through holes 34 in the adapter plate 30 and thread or otherwise lock into holes 35 in the electrical module 14. Alternatively, the adapter plate 30 could be fastened to holes 36 in the terminals 24 and 25 of input member 22.

Those having ordinary skill in the art will recognize that the adapter plate 30 shown in FIG. 1 may be selectively mated to the electrical module 14 in one of four positions, providing for four different, selectable positions for the connecting member 16 relative to the electrical module 14. FIGS. 2A, 2B, 2C, and 2D show partial, exploded views of the electrical module 14 and adjustable connecting member 16 in four different connecting member positions, with the cable connectors 12 removed for clarity.

Because the position of cable connector 12 is fixed with respect to the adjustable connecting member 16, the four different connecting member positions, in turn, selectively provide four different cable takeoff directions 20A, 20B, 20C, and 20D, relative to the electrical module 14 (and to the input member 22). In the embodiment shown, the four cable takeoff directions 20A-D are separated by approximately ninety degrees, and rotate about an axis 38 running generally through the center of the terminals 24 and 25.

Two bus bars 40 and 41 provide structure within the adjustable connecting member 16 for electrical communication between the terminals 24 and 25 and the cable ports 18 and 19. The bus bars 40 and 41 may be attached to, or embedded in, the adapter plate 30. Additionally, the bus bars 40 and 41 may be overmolded in the material of the adapter plate 30 and cradles 26. The bus bars 40 and 41 are configured such that, when the adapter plate 30 is mated to the electrical module 14 in any one of the four positions, each of the bus bars 40 and 41 come into electrical communication with one of the terminals 24 and 25.

The bus bars 40 and 41 are further configured to communicate, directly or through connector blades 42 and 43 (described below), with the cable connectors 12 and the cable ports 18 and 19. In the embodiment shown in FIGS. 1 and 2A-2D, one terminal 24 or 25 communicates with one bus bar 40 or 41, such that each bus bar 40 and 41 carries a single polarity charge (positive, negative, or neutral) in the electrical circuit.

Figure 2A:
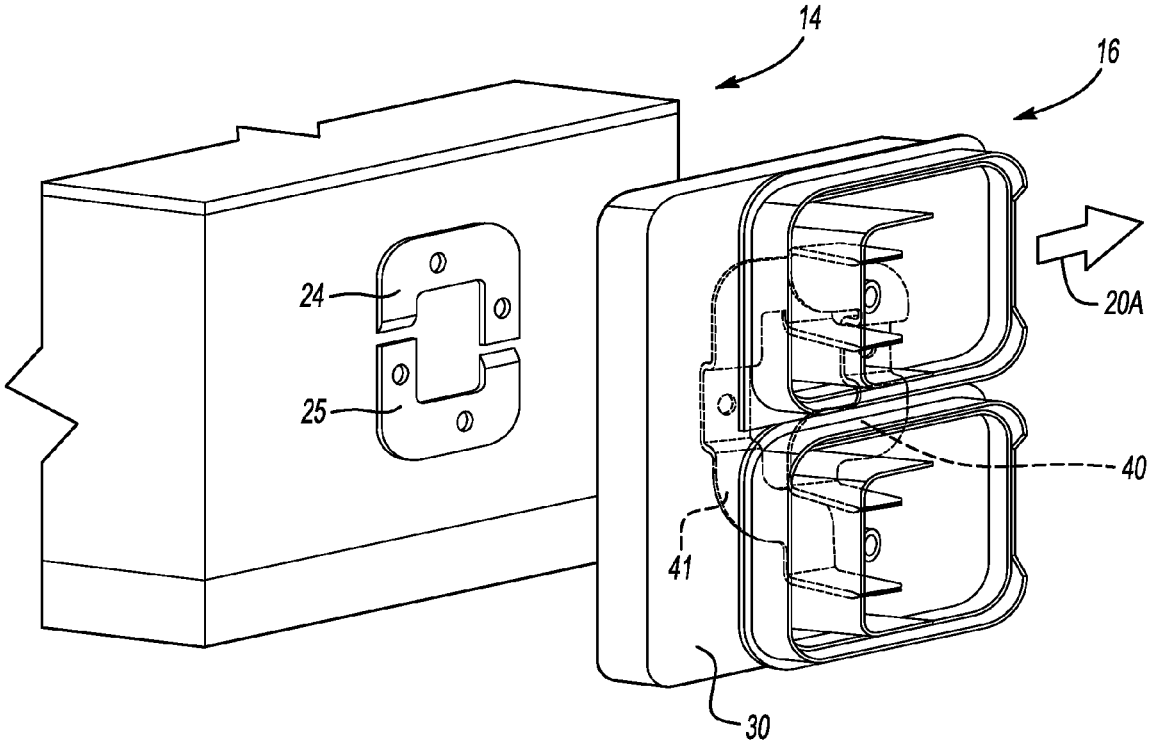
FIGS. 2A-2D are schematic, exploded, perspective views of a portion of the variable direction cable connector adapter of FIG. 1, shown with the connecting member oriented to provide four selectable, different cable takeoff directions 20A-20D, respectively, for attachment of the cable connectors.
Figure 2B:
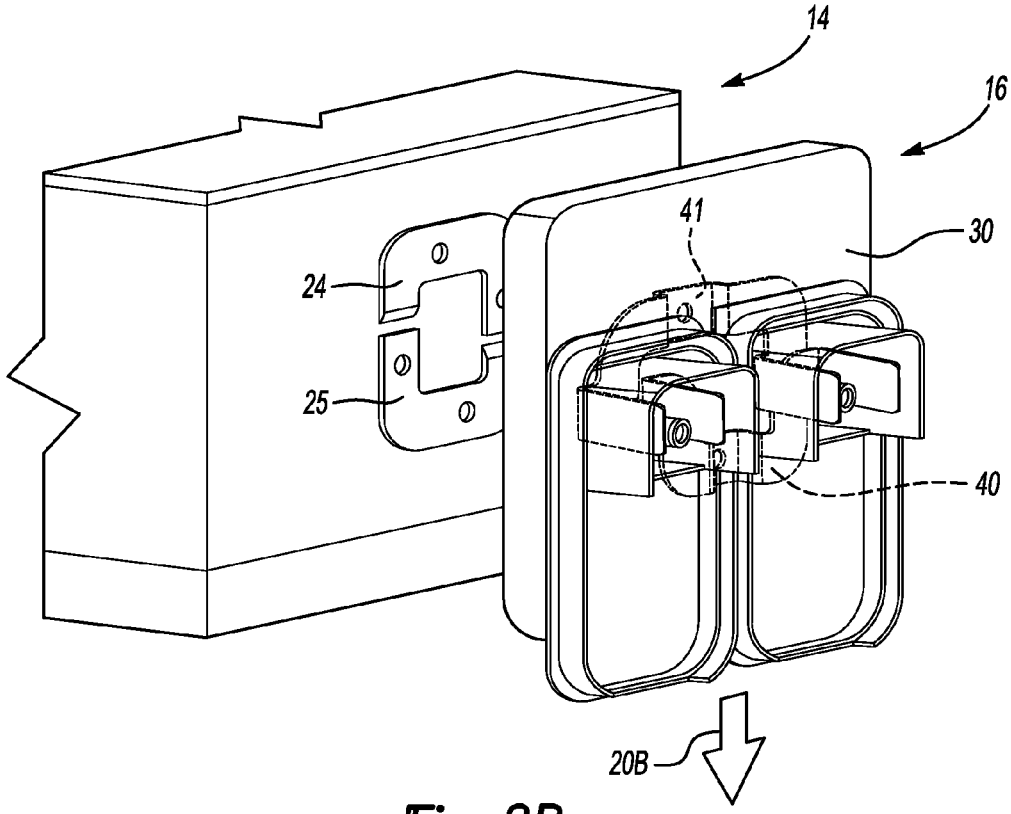
Figure 2C:
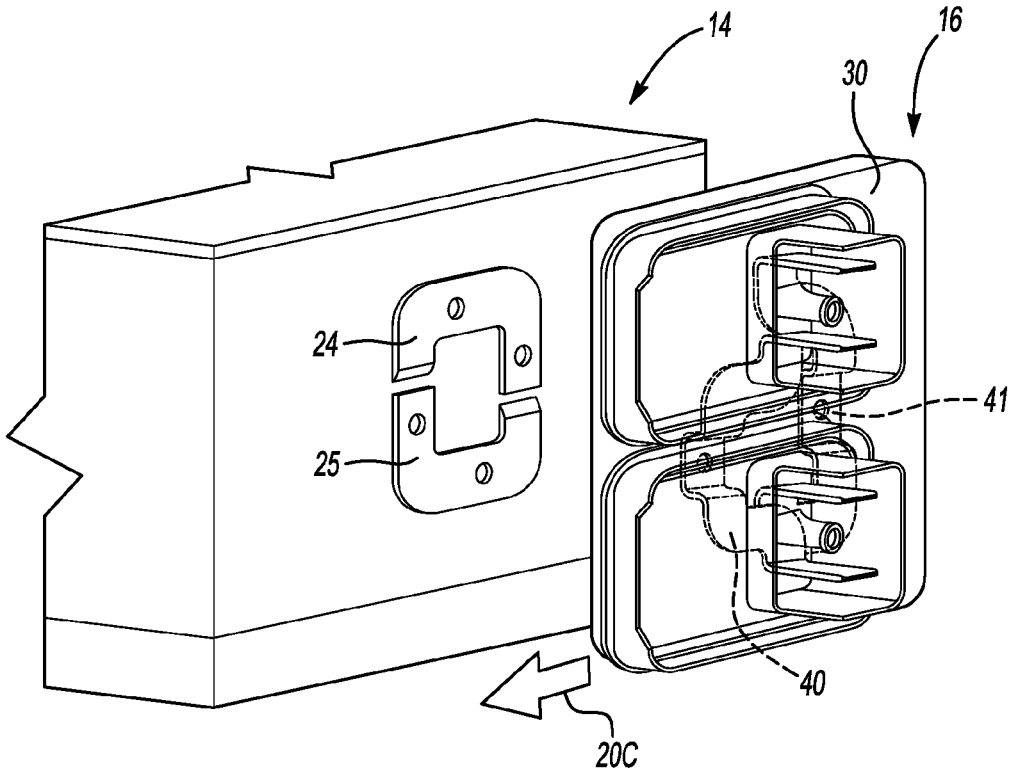
Figure 2D:
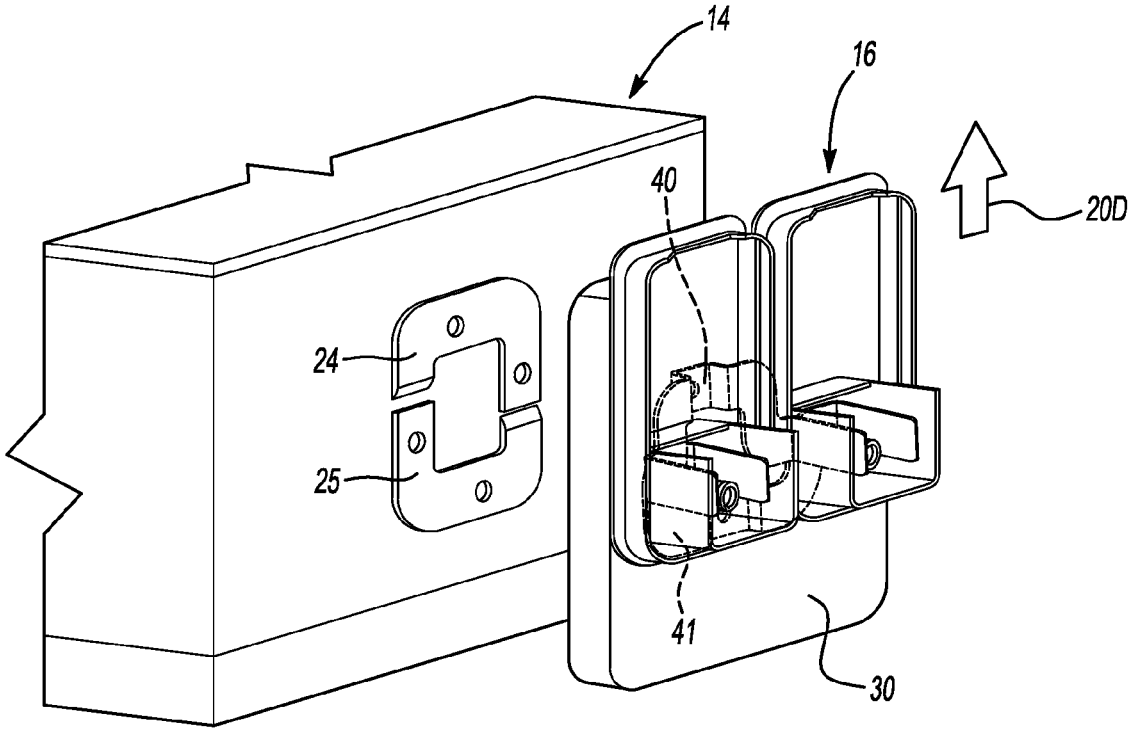

As may be best viewed in FIG. 1, each cable port 18 or 19 communicates with only one of the bus bars 40 or 41, such that each cable port 18 or 19 (and attached cable) correspondingly has only one polarity (carries a single direction of electron flow). One of the blades 42 plugs into a slot or channel (not shown) in the cable connector 12, which communicates with the cable port 18, and one of the blades 43 plugs into cable connector 12 and communicates with the cable port 19. Those having ordinary skill in the art will recognize that the adjustable connecting member position shown in FIG. 1, and having cable takeoff direction 20, is also shown in FIG. 2A, with corresponding cable takeoff direction 20A.

Figure 3:
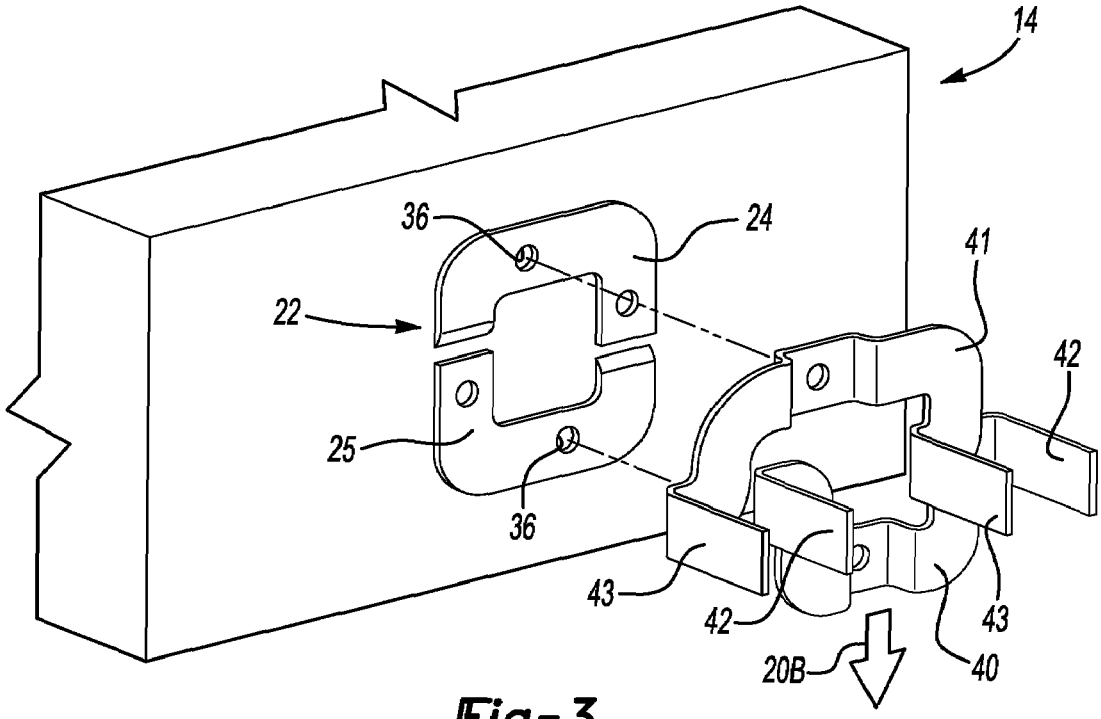
FIG. 3 is a schematic, exploded, perspective view showing the interface between the input member and bus bars of the partial variable direction cable connector adapter as shown in FIG. 2B, with corresponding cable takeoff direction 20B.

FIG. 3 shows an exploded, isolated view of the input member 22 and the bus bars 40 and 41. To better show the structure of the bus bars 40 and 41 and the connections between the adjustable connecting member 16 and the electrical module 14, the remainder of the adjustable connecting member 16 and the cable connectors 12 have been removed for clarity. The orientation shown in FIG. 3 corresponds generally to that shown in FIG. 2B, having cable takeoff direction 20B. To facilitate connection to two cable connectors 12, bus bar 40 has two connector blades 42 and bus bar 41 has two connector blades 43.

Those having ordinary skill in the art will recognize that, in the embodiment shown in FIGS. 1-3, moving from one position of the adapter plate 30 to another position may result in reversing the polarity of the bus bars 40 and 41 by changing the terminal 24 or 25 to which each bus bar 40 or 41 connects. Referring again to FIGS. 2A-2D, the configuration of the terminals 24 and 25 and bus bars 40 and 41 is such that the polarity of the bus bars 40 and 41 is the same in FIGS. 2A and 2D, and the polarity is similarly unchanged between FIGS. 2B and 2C.

The two-phase input member 22 shown in FIGS. 1, 2A-2D, and 3 may have, for example, terminal 24 as the positive pole and terminal 25 as the negative pole. In such a case, Table 1 shows the corresponding negative and positive poles for bus bars 40 and 41 in FIGS. 2A-2D:

TABLE 1

| FIGS. | Direction | Terminal 24 Positive Bus | Terminal 25 Negative Bus |
|---|---|---|---|
| 1, 2A | 20A | 40 | 41 |
| 2B, 3 | 20B | 41 | 40 |
| 2C | 20C | 41 | 40 |
| 2D | 20D | 40 | 41 |

From the above table, those having ordinary skill in the art will recognize that cable takeoff directions 20A and 20D communicate identical polarity to the cable connector 12. Additionally, cable takeoff directions 20B and 20C are identical to each other, but have reversed polarity relative to directions 20A and 20D.

Because each of the cable ports 18 and 19 may have different polarity, depending upon the position of adjustable connecting member 16, the adapter 10 may include structure or markings configured to identify the polarity of each cable or cable port 18 or 19 once the adapter 10 is fully assembled. Those having ordinary skill in the art will recognize structures capable of identifying the polarity of the assembled adapter 10. Possible structures include, without limitation, markings on the walls of the electric module 14 that identify the resulting polarity of cables passing over the specified wall for the corresponding cable takeoff direction 20A, 20B, 20C, or 20D.

Using the embodiment shown in FIGS. 1-3 as an example, several manufacturing strategies are possible for the adapter 10. Generally, the last component attached to the assembled adapter 10 will be the cable connector (or connectors) 12. The electrical module 14 and adjustable connecting member 16 may be assembled together and then attached to the vehicle chassis (not shown) or portion of the drivetrain (not shown). One or more cable connectors 12 may then be attached to the adjustable connecting member 16 (already in position for the appropriate cable takeoff direction 20A-20D) and the opposing end of the cables attached to the relevant vehicle component (such as, for example: a similar adapter 10, an electric motor/generator, or an energy storage device).

The adjustable connecting member 16 and electrical module 14 may be manufactured and delivered separately, such that final assembly may be made into vehicles needing any of the cable takeoff directions 20A-20D. Under this type of manufacturing process, the electrical module 14 and adjustable connecting member 16 would have individual part numbers and identification of resulting cable polarity after assembly may be important to ensure that the cables are not affixed to other vehicle components with improper (reversed) polarity.

Alternatively, the electrical module 14 and adjustable connecting member 16 may be supplied as an assembled unit, with the final cable takeoff direction 20A, 20B, 20C, or 20D selected by the supplier during assembly. In such a manufacturing process, each pre-assembled adapter 10 with pre-selected cable takeoff direction 20A, 20B, 20C, or 20D would have its own unique part number to identify the proper adapter 10 for each vehicle. Furthermore, the associated vehicle components receiving the cables would have corresponding harnesses (or cable connectors) to ensure that the proper polarity is maintained between the uniquely-numbered adapter 10 and corresponding component.

As shown in FIG. 1, the adjustable connecting member 16 may be configured with two cradles 26, such that two cable connectors 12 may be mated thereto. In order to attach two or more cable connectors 12, each bus bar 40 and 41 must have structure configured to communicate with a respective cable port 18 or 19 on each of the cable connectors 12.

In the embodiment shown in FIG. 1, each of the connector blades 42 of bus bar 40 communicates with the cable port 18 on a respective cable connector 12 (only one of which is shown), such that the upper cable (as viewed in FIG. 1) extending from each cable connector 12 communicates with bus bar 40 (and therefore with terminal 24). Similarly, both of the connector blades 43 of bus bar 41 communicate with the cable ports 19 and the lower cables extending from each cable connector 12.

The capability to attach multiple cable connectors 12 to the adjustable connecting member 16, and provide the different cable takeoff directions 20A-20D, results from respective single contact points between the bus bars 40 and 41 and the terminals 24 and 25 being in communication with multiple cable ports 18 or 19. Those having ordinary skill in the art will recognize that variations on this structure could allow attachment of more than two cable connectors 12 by utilizing additional contact elements (such as, but not limited to, additional connector blades 42 or 43) between the bus bars 40 and 41 and the cable connectors 12.

In the embodiment shown in FIGS. 1-3, the connector blades 42 and 43 form a plug to which the cable connectors 12 may be attached. Those having ordinary skill in the art will recognize that other connector shapes may be used to electrically communicate between the bus bars 40 and 41 and the cable connectors 12 and cable ports 18 and 19. It will also be recognized by those having ordinary skill in the art that the connection need not necessarily be a plug-in type connection.

Those having ordinary skill in the art will recognize other variations on the embodiment shown in FIGS. 1-3. Such variations include, without limitation: an embodiment having two, single-cable connectors, where each bus bar 40 and 41 connects to a respective single-cable connector, such that each single-cable connector carries a single charge into a single cable (as opposed to individual cables on each connector 12 having a single charge).

Those having ordinary skill in the art will further recognize that the terminals 24 and 25 and bus bars 40 and 41 need not be square shaped. Alternative embodiments may, for example, utilize other polygonal shapes to provide other fixed positions, or circular terminals to allow infinite positions (as will be described below).

Figure 4:
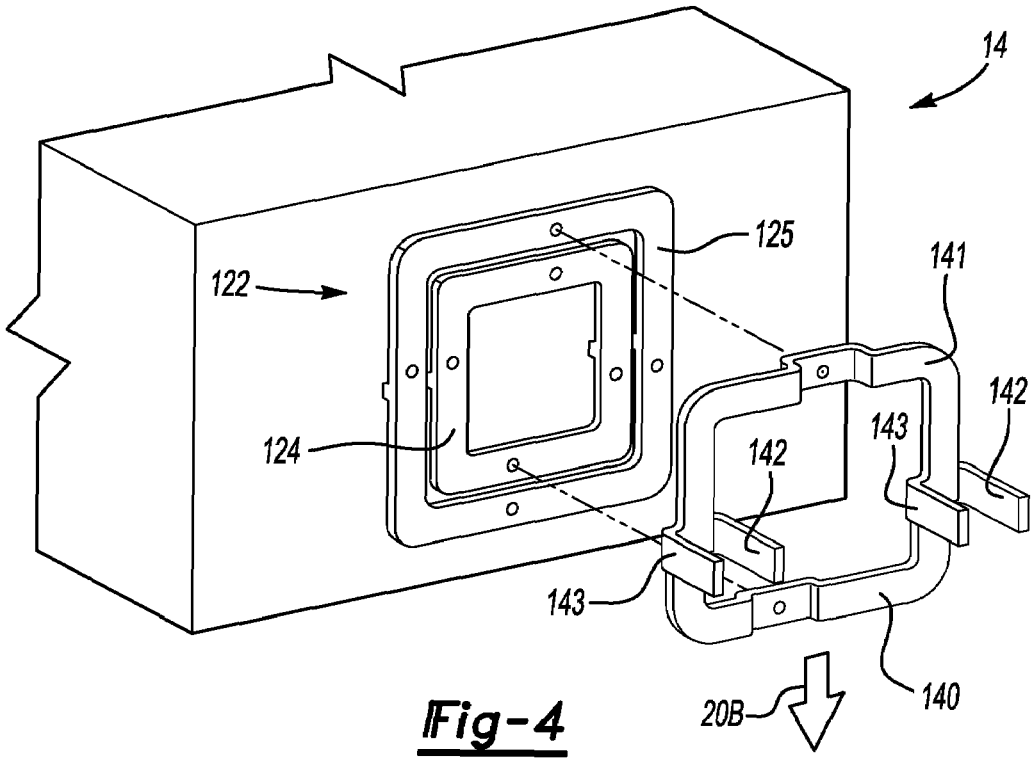
FIG. 4 is a schematic, exploded, perspective view showing another embodiment of the interface between the input member and bus bars for a variation on the variable direction cable connector adapter of FIGS. 1-3, this embodiment having concentric bus bars configured to provide the same polarity to the cable connectors in each of the four different cable takeoff directions 20A-20D.

Referring now to FIG. 4, there is shown an alternative embodiment to the input member 22 and bus bars 40 and 41 shown in FIGS. 1-3. Similar to FIG. 3, FIG. 4 shows an exploded, isolated view of an input member 122 and bus bars 140 and 141, oriented to provide the cable takeoff direction 20B.

In the embodiment partially shown in FIG. 4, regardless of the position in which the adjustable connecting member (of which only the bus bars 140 and 141 are shown) is attached to the electrical module 14, the bus bars 140 and 141 carry the same polarity. A terminal 124 (which may be the positive terminal) forms a square ring inside of a terminal 125 (which may be the negative terminal), which is also a square ring and is concentric about the terminal 124.

The concentric terminals 124 and 125 allow the bus bars 140 and 141 to always mate to the same terminal—and therefore carry the same charge—regardless of cable takeoff direction 20A, 20B, 20C, or 20D selected. In the embodiment shown in FIG. 4, the bus bar 140 always contacts the terminal 124 and the bus bar 141 always contacts the terminal 125. Connector blades 142 and 143 connect bus bars 140 and 141, respectively, to the cable connectors (not shown). Therefore, respective cable ports 18 and 19 (not shown) always carry the same polarity.

Figure 5:
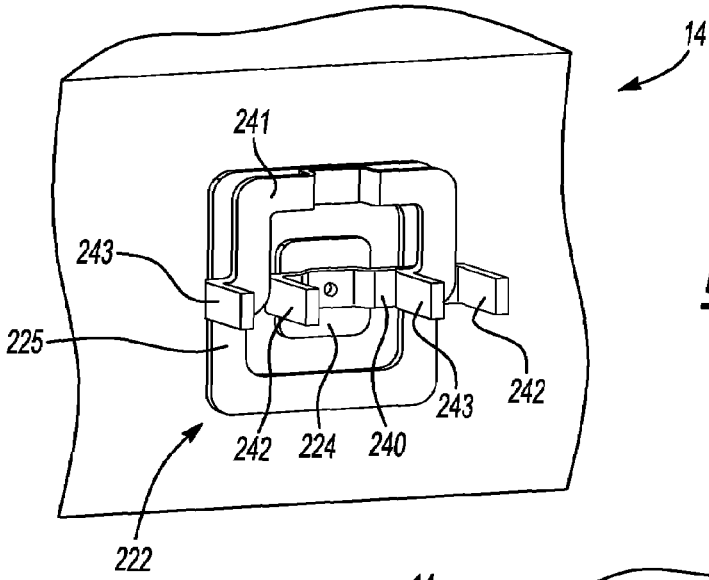
FIG. 5 is a schematic, perspective view showing another embodiment of the interface between the input member and bus bars, having a solid inner bus bar and concentric outer bus bar.

Referring now to FIG. 5, there is shown another embodiment of an input member 222 and bus bars 240 and 241 usable within the scope of the claimed invention. A central terminal 224 is surrounded by a concentric terminal 225. Like the terminals 124 and 125 of FIG. 4, the configuration of the terminals 224 and 225 allows the bus bars 240 and 241 to always mate to a respective one of the terminals 224 and 225, such that polarity of the cable ports 18 and 19 (not shown in FIG. 5) and cables (not shown) is not dependant upon the cable takeoff direction 20A-20D selected.

Similar to the input members 22 and 112 of FIGS. 1-3 and 4, respectively, the square ring configuration of the input member 222 allows for the adjustable connecting member (of which, only the bus bars 240 and 241 of the connecting member are shown in FIG. 5) to be selectively mated to the electrical module 14 in one of four positions, at ninety degree intervals. Connector blades 242 and 243 facilitate communication between the bus bars 240 and 241, respectively, and the cable connectors 12 (not shown in FIG. 5). FIG. 5 also shows the bus bars 240 and 241 oriented to provide the cable takeoff direction 20B.

Figure 6:
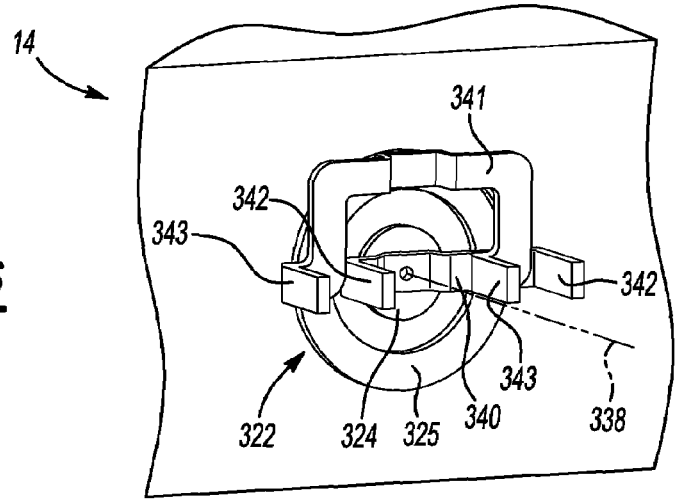
FIG. 6 is a schematic, perspective view showing another embodiment of the interface between the input member and bus bars, having a central inner bus bar and a round concentric outer bus bar, providing infinite selectable attachment positions about the central axis.

Referring now to FIG. 6, there is shown another embodiment of an input member 322 and bus bars 340 and 341 usable within the scope of the claimed invention. In this embodiment, a central terminal 324 is surrounded by a concentric, circular terminal 325. The concentric terminals 324 and 325 allow the connecting member (of which, only the bus bars 340 and 341 are shown in FIG. 6) to mate to the input member 322 in multiple positions without changing the polarity of the bus bars 340 and 341.

Because the input member 322 is configured with concentric, circular terminals 324 and 325, the bus bars 340 and 341 (and the remainder of the connecting member, not shown) may be mated to the input member 322 in infinite positions. This differs from the square-shaped terminals 24, 25, 124, 125, 224, and 225; which require connecting member positions separated by ninety degree intervals for consistent surface area of the contact between the terminals 24, 25, 124, 125, 224, and 225 and bus bars 40, 41, 140, 141, 240, and 241.

The terminals 324 and 325 provide substantially equal contact with the bus bars 340 and 341 regardless of the angular orientation of the bus bars about an axis 338 at the center of the terminals 324 and 325. Therefore, while FIG. 6 shows the bus bars 340 and 341 generally oriented to provide a cable takeoff direction substantially similar to takeoff direction 20B, any direction in between (and inclusive of) cable takeoff directions 20A-20D is possible with the structure shown in this embodiment. Connector blades 342 and 343 may be provided to communicate with the cable connectors 12 (not shown in FIG. 6).

In the embodiments shown in FIGS. 1-6, the adapter 10 is a two-phase adapter configured for cable connectors 12 having structure for two cables (not shown). However, some electrical modules 14 may require three-phase adapters for three-cable cable connectors. These embodiments may be used to carry direct current with a ground connection (in addition to positive and negative); may be used for alternating current with live, neutral, and ground connections; or may be used for another three-phase connection (in which the phases may be nominally referred to as U, V, and W).

Figure 7:
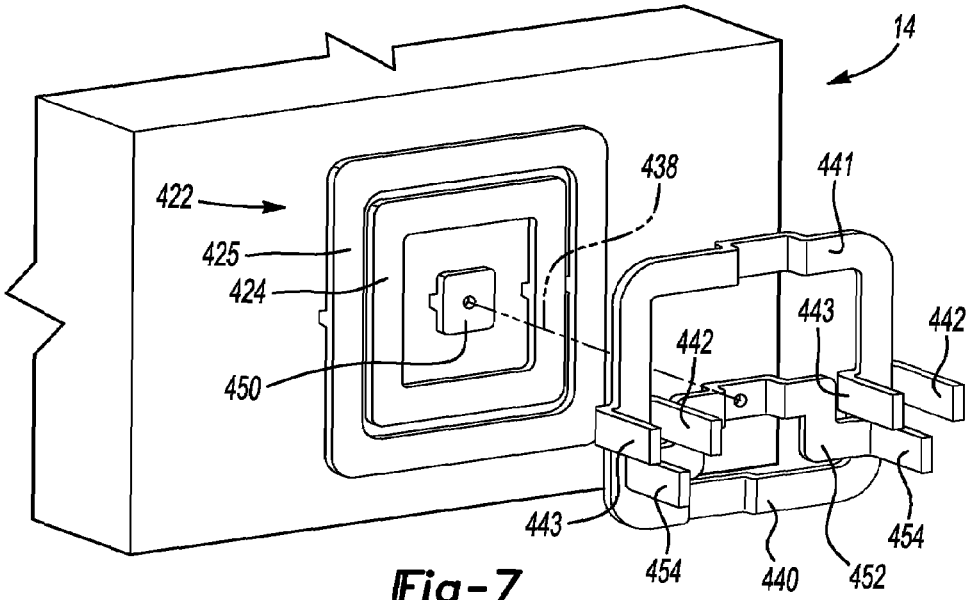
FIG. 7 is a schematic, exploded, perspective view showing yet another embodiment of the interface between the input member and bus bars for another embodiment of a variable direction cable connector adapter, this embodiment having three concentric bus bars configured to provide the same polarity for selectable, different cable takeoff directions and three-phase electrical communication with two, three-cable connectors.

FIG. 7 shows a three-phase embodiment of an input member 422. In the embodiment shown, an outer square ring terminal 425 surrounds, and is concentric with, an inner square ring terminal 424. The input member 422 also includes a third, central terminal 450 located inside of the concentric square ring terminals 424 and 425.

Terminals 424, 425, and 450 are concentric about an axis 438. Therefore, the polarity of the connections is not dependent on connecting member position. Regardless of the cable takeoff direction 20A-20D, a bus bar 441 communicates with the terminal 425, a bus bar 440 communicates with the terminal 424, and a third bus bar 452 communicates with the third terminal 450.

Similar to the embodiments shown in FIGS. 1-6, the bus bars 440 and 441 are configured with connector blades 442 and 443, respectively, to communicate with the cable connectors (not shown). Additionally, the third bus bar 452 has connector blades 454 to communicate with a third cable on the cable connectors.

Those having ordinary skill in the art will recognize that, in addition to high-voltage cable connections, the variable direction cable connector adapter 10 may be used for connection of electrical modules sending commands or signals over the connected cables. For example, each of the three terminals 424, 425, and 450 of the three-phase input member 422 shown in FIG. 7 may be configured to receive or output a unique signal. An adaptor allowing multiple cable takeoff directions may also reduce cable length, bend radius, and installation difficulty for electrical modules configured for signal communication. Similarly, by adding additional concentric terminals and associated bus bars, more than three signals (or high-voltage phases) could be communicated to a cable connector having more than three cables.

While the best modes and other embodiments for carrying out the claimed invention have been described in detail, those familiar with the art to which this invention relates will recognize various alternative designs and embodiments for practicing the invention within the scope of the appended claims.

The invention claimed is:

1. An adjustable adapter for a cable connector having a fixed cable takeoff direction relative to the cable connector having a first and a second cable port, comprising:

an electric module having an input member having a first terminal and a second terminal positioned on a first side thereof;

a connecting member having a first bus bar and a second bus bar, wherein said connecting member is configured to selectively mate to said input member in at least two different connecting member positions relative to said input member, wherein said input member is between said connecting member and said first side of said electric module in both of said at least two different connecting member positions and both of said at least two different connecting member positions are on the same side of said input member, such that in each of said at least two different connecting member positions each of said first and second bus bars is in electrical communication with a respective one of said first and second terminals; and wherein said connecting member is configured to accept attachment of the cable connector and said first bus bar is configured to communicate with the first cable port and said second bus bar is configured to communicate with the second cable port, such that said connecting member provides the cable connector with at least two different cable takeoff directions relative to said input member corresponding to said at least two different connecting member positions.

2. The adapter of claim 1, wherein said connecting member further includes an adapter plate configured to facilitate mating of the cable connector to said connecting member and mating of said connecting member to said input member.

3. The adapter of claim 2, wherein said first and second bus bars are embedded in said adapter place.

4. The adapter of claim 3, further comprising:

a first connector blade operatively attached to said first bus bar;

a second connector blade operatively attached to said second bus bar; and wherein said first and second connector blades are configured to mate with the cable connector for electrical communication therewith.

5. The adapter of claim 4, further comprising:

a third connector blade operatively attached to said first bus bar;

a fourth connector blade operatively attached to said second bus bar; and wherein said connecting member is further configured to accept a second cable connector, and wherein said third and fourth connector blades are configured to mate with the second cable connector for electrical communication therewith.

6. The adapter of claim 5, further comprising:

a third terminal;

a third bus bar embedded in said adapter plate, wherein said connecting member is further configured such that said third bus bar is in electrical communication with said third terminal; and a fifth connector blade operatively attached to said third bus bar, wherein said fifth connector blade is configured to mate with the cable connector for electrical communication therewith.

7. The adapter of claim 6, wherein said first and second bus bars are overmolded in said adapter plate.

8. The adapter of claim 7, further comprising a power inverter module wherein said first and second terminals are operatively connected to said power inverter module.

9. The adapter of claim 8, wherein said connecting member is further configured to selectively mate to said input member in at least four different connecting member positions, such that the cable connector has at least four different cable takeoff directions relative to said input member corresponding to said at least four different connecting member positions.

10. The adapter of claim 1, wherein said connecting member is further configured to selectively mate to said input member in at least four different connecting member positions, such that the cable connector has at least four different cable takeoff directions relative to said input member corresponding to said at least four different connecting member positions, and in each of said at least four different connecting member positions each of said first and second bus bars is in electrical communication with a respective one of said first and second terminals.

11. The adapter of claim 10, wherein said second bus bar is concentric about said first bus bar, and said first and second bus bars are configured such that in each of said at least four different connecting member positions, said first bus bar is in electrical communication with said first terminal and said second bus bar is in electrical communication said second terminal.

12. The adapter of claim 11, further comprising:

an adapter plate configured to facilitate mating of the cable connector to said connecting member and mating of said connecting member to said input member; and wherein said first and second bus bars are embedded in said adapter plate.

13. An electrical module providing selectable cable takeoff directions, comprising:

an electric module having an input member having a first terminal and a second terminal positioned on a first side thereof;

an adapter plate;

a first cable connector having a first fixed cable port and a second fixed cable port, wherein said cable connector is configured to mate to said adapter plate;

a first bus bar and a second bus bar embedded in said adapter plate;

wherein said adapter plate is configured to selectively mate to said input member in at least two different adapter plate positions relative to said input member, wherein said input member is between said adapter plate and said first side of said electric module in both of said at least two different adapter plate positions and both of said at least two different adapter plate positions are on the same side of said input member, such that in each of said at least two different adapter plate positions each of said first and second bus bars is in electrical communication with a respective one of said first and second terminals; and wherein said adapter plate is configured to accept attachment of said first cable connector, said first bus bar is configured to communicate with said first fixed cable port, and said second bus bar is configured to communicate with said second fixed cable port, such that said first cable connector has at least two different cable takeoff directions relative to said input member corresponding to said at least two different adapter plate positions.

14. The electrical module of claim 13, further comprising a second cable connector having a fourth fixed cable port and a fifth fixed cable port, wherein said second cable connector is configured to mate to said adapter plate.

15. The electrical module of claim 14, further comprising a third terminal; and a third bus bar embedded in said adapter plate, wherein said adapter plate is further configured such that said third bus bar is in electrical communication with said third terminal.

16. The electrical module of claim 15, further comprising:

a first connector blade operatively attached to said first bus bar;

a second connector blade operatively attached to said second bus bar;

a third connector blade operatively attached to said third bus bar;

wherein said first cable connector further includes a third fixed cable port; and wherein said first, second, and third connector blades are configured to mate with said first, second, and third fixed cable ports of said first cable connector, respectively, for electrical communication therewith.

17. The electrical module of claim 16, further comprising:

a fourth connector blade operatively attached to said first bus bar;

a fifth connector blade operatively attached to said second bus bar;

a sixth connector blade operatively attached to said third bus bar;

wherein said second cable connector further includes a sixth fixed cable port; and wherein said fourth, fifth, and sixth connector blades are configured to mate with said fourth, fifth, and sixth fixed cable ports, respectively, of said second cable connector for electrical communication therewith.

18. The electrical module of claim 17, wherein said adapter plate is further configured to selectively mate to said input member in at least four different adapter plate positions, such said first and second cable connectors have at least four different cable takeoff directions relative to said input member corresponding to said at least four different connecting member positions.

19. The electrical module of claim 18 further comprising:

a central axis, wherein said first, second, and third bus bars are concentric about said central axis; and wherein said first, second, and third bus bars are configured such that in each of said at least four different adapter plate positions said first bus bar is in electrical communication with said first terminal, said second bus bar is in electrical communication said second terminal, and said third bus bar is in electrical communication with said third terminal.

* * * * *